United States Patent [19]

Raseley et al.

[11] 4,236,575

[45] Dec. 2, 1980

[54] TUBE BUNDLE SUPPORT PLATE

[75] Inventors: LeRoy J. Raseley, Saylorsburg; Leslie L. Forster, Easton, both of Pa.; Edward F. Hay, Belvidere, N.J.

[73] Assignee: Ecolaire Incorporated, Malvern, Pa.

[21] Appl. No.: 78,619

[22] Filed: Sep. 24, 1979

[51] Int. Cl.[3] ..... F28B 1/02; F28B 9/04; F28F 9/00

[52] U.S. Cl. ..... 165/113; 122/510; 165/162

[58] Field of Search ..... 165/113, 114, 161, 162, 165/159; 122/483, 510

[56] References Cited

U.S. PATENT DOCUMENTS

| | | | |
|---|---|---|---|
| 1,745,857 | 2/1930 | Lucke | 165/113 |
| 1,941,650 | 1/1934 | Bawmann | 165/114 |
| 2,496,301 | 2/1950 | Meixl | 165/162 |
| 3,094,165 | 6/1963 | Droescher | 165/113 |

OTHER PUBLICATIONS

Steam Condensers, Ecolaire Condenser, Brochure, 1977.

*Primary Examiner*—Sheldon Richter

*Attorney, Agent, or Firm*—Seidel, Gonda, Goldhammer & Panitch

[57] ABSTRACT

The air cooler section of a steam condenser which is normally untubed is provided with tubes thereby increasing the capacity and/or efficiency of the condenser without interfering with the longitudinal flow of vapor.

4 Claims, 2 Drawing Figures

FIG. 1
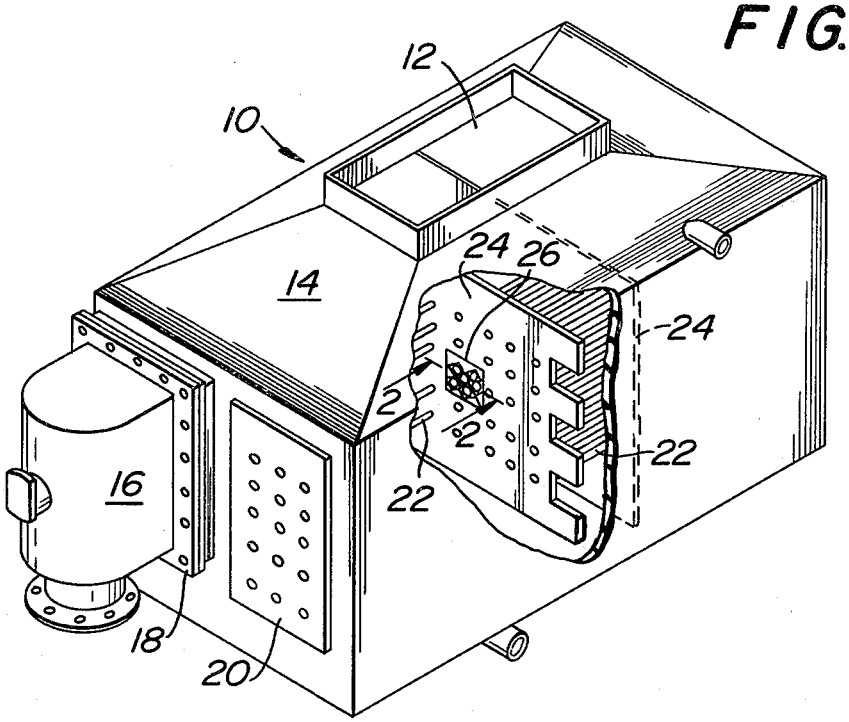
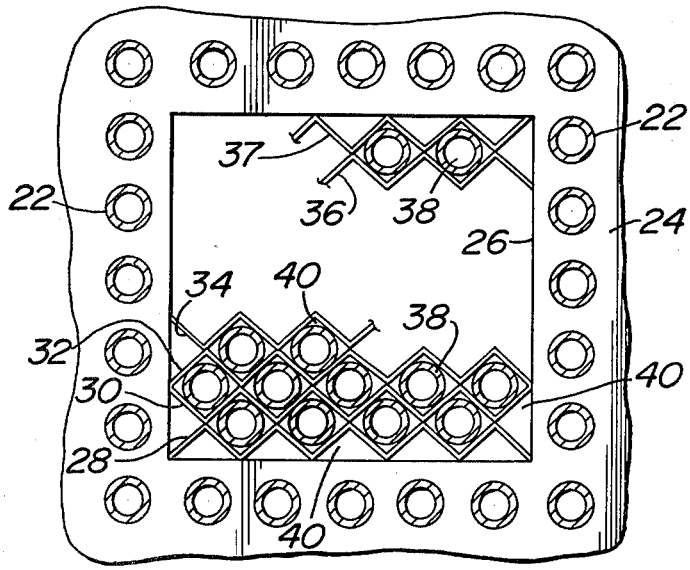
FIG. 2

TUBE BUNDLE SUPPORT PLATE

BACKGROUND OF THE INVENTION

For decades, it has been conventional in connection with heat exchangers such as a steam condenser to employ the concept of a cascading air cooler section with controlled velocities to preclude stagnation. Air coolers in a condenser cool any non-condensable gases that have entered the condenser and before they are exited to thereby condense as much of the steam associated with these gases as possible. Air coolers take advantage of the pressure gradient inherent within a tube bundle between the inlet and outlet water ends to provide a positive flow from the hot end to the cold end with the air vapor outlets located at the cold end. In a conventional steam condenser, the air cooler section has a hole of significant size centrally located in each of the tube support plates. The area displaced by the hole is an untubed region of the tube bundle.

In some designs of multi-pass condensers, the air cooler is located in the cold water pass only. The air cooler openings in the tube support plates must often be located in a progressively elevated manner along the length of the cold water pass from its warm end to its cold end. As a result, a substantial area of the tube bundle must be left untubed to provide for this progressive variation in air cooler opening location along the length of the cold water pass. The present invention eliminates this untubed area since, no matter where the location of the air cooler opening occurs, the opening will be fully tubed while at the same time permitting proper operation of the air cooler.

SUMMARY OF THE INVENTION

Heat exchangers such as steam condensers utilize tube support plates for supporting the tubes along their length. Each tube support plate has a large number of parallel holes therethrough with each of the holes being adapted to support a heat exchange tube. The central area of the tube support plate has an opening substantially larger than any one of said holes. A grid means is supported by each tube support plate in or adjacent to the opening for supporting a plurality of heat exchange tubes which extend through the opening. The grid means is constructed so as to provide for a plurality of unobstructed gas flow passages in the opening longitudinally of the tubes.

It is an object of the present invention to provide a heat exchanger such as a steam condenser with a more efficient air cooler wherein steam and non-condensable gases flow longitudinally in an area of tubes rather than in an untubed area thereby providing an overall smaller tube bundle.

It is another object of the present invention to provide a steam condenser with a more efficient air cooler and which has said air cooler operating on the principle of completely parallel flow in a close and intimate steam and non-condensable gas environment as opposed to an air cooler operating on partial crossflow with substantially less close and intimate environment of said steam and non-condensable gases and to do this without the need for additional hardware between tube support plates. Other objects appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a steam condenser incorporating the present invention.

FIG. 2 is a view taken along the line 2—2 in FIG. 1 but on an enlarged scale.

Referring to the drawings in detail, wherein like numerals indicate like elements, there is shown a heat exchanger such as a steam condenser designated generally as 10. The shell of the condenser 10 has an inlet 12 above a dome 14. The condenser shell will have water boxes 16 at each end. A plurality of horizontally disposed tubes 22 are secured at their ends to tube sheets 18, 20.

Intermediate the tube sheets at opposite ends of the tubes, there is provided a plurality of tube support plates 24. The tube plates 24 are frequently of substantial size and thickness. A plurality of holes are drilled in the tube support plates 24 with each hole receiving one of the heat exchange tubes 22.

For many years, it has been conventional to provide an opening 26 in the central area of the support plates 24. The openings 26 and adjacent tubes constitute an air cooler which conventionally includes a baffle plate between adjacent support plates so as to promote partial crossflow of the steam and non-condensable gases from the preceding opening 26. Steam and non-condensable gases flow longitudinally through the openings 26 from the hot end to the cold end where they are exited. The openings 26 result in an untubed area.

In accordance with the present invention, the conventional untubed area represented by the openings 26 is provided with tubes without interfering with the provision for space to enable steam and non-condensable gases to flow longitudinally from the hot end to the cold end. The openings 26 are tubed in a manner which does not interfere with the conventional process for constructing the support plates 24.

A grid means is provided in or adjacent each opening 26 in the support plates 24. As illustrated in FIG. 2, the grid means includes a plurality of support strips 28, 30, 32, 34 and 36. Each support strip has a plurality of interconnected V-shaped members. One or more apexes on each of the support strips is interlocked with a mating apex on the support strip thereabove so as to form a structural unit whereby the tubes 38 do not support any of the weight of the tubes thereabove. The support strips 28–36 may be interlocked with one another by having an upwardly extending projection on the upper apex of each support strip with a mating hole on the lower apex of each support strip for receiving the projection with line contact between mating apexes.

As shown in FIG. 2, the mating strips 28–36 cooperate with one another to form diamond-shaped openings for receiving the tubes 38. The tubes 38 have line contact in two places with the legs of the V-shaped members therebelow without contacting the legs of the V-shaped member thereabove. Hence, the tubes 38 may be removed or replaced without interfering with any of the adjacent tubes 38. As a result, there is provided a plurality of spaces 40 to accommodate longitudinal flow of steam and non-condensable gases through the openings 26 in each of the support plates 24.

Since the untubed area defined by the openings 26 may now contain tubes, the overall tube bundle may be made smaller, conventional hardware normally used in the air cooler section may be eliminated while at the same time providing intimate and close contact between the vapors and tubes 38 for efficient and effective air cooler operation. The openings 26 need not be square but instead may have other shapes.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus for use in a heat exchanger such as a condenser comprising a tube bundle support plate, said plate having a large number of holes therethrough, each of said holes being adapted to support a heat exchange tube, the central area of said plate having an opening substantially larger than one of said holes, a grid means supported by said plate in or adjacent said opening for supporting a plurality of heat exchange tubes intended to extend through said opening, said grid means being constructed so as to provide for a plurality of unobstructed gas flow passages through said opening.

2. Apparatus in accordance with claim 1 wherein said grid means includes a plurality of undulating strips disposed above one another within said openings, the strips associated with one of said openings being interlocked with one another so as to form a vertical structural unit for supporting the weight of tubes extending through said openings in a manner so that the tubes extending through said openings are supported with line contact from below and do not support the weight of tubes thereabove.

3. Apparatus in accordance with claim 1 wherein the overall size of the tube bundle is reduced by the number of tubes extending through said openings, and the tubes extending through said openings being spaced from contact with the periphery of the openings by said grid means.

4. A tube bundle for use in a heat exchanger such as a condenser comprising a plurality of tube support plates, each plate having a large number of holes therethrough, each hole in each plate being aligned either directly or in a progressively elevated manner with a hole in the other plates, a plurality of heat exchange tubes, each heat exchange tube extending through a set of said aligned holes in said plates, each plate in a central area thereof having a large opening, the large openings being aligned, a discrete grid means supported by each plate for supporting a plurality of heat exchange tubes extending through said openings and parallel to said first-mentioned tubes, each grid means being constructed so as to provide for a plurality of unobstructed gas flow passages in each opening between adjacent tubes disposed within each opening, each grid means including a plurality of undulating strips disposed above one another within said openings, the strips associated with one of said openings being interlocked with one another so as to form a vertical structural unit for supporting the weight of tubes extending through said openings in a manner so that the tubes extending through said openings are supported with line contact from below and do not support the weight of tubes thereabove, said openings having a plurality of aligned spaces between adjacent tubes for axial flow of gases, the overall size of the tube bundle being reduced by the number of tubes extending through said openings, and the tubes extending through said openings being spaced from contact with the periphery of the openings by said grid means.

* * * * *